US011879190B2

(12) United States Patent
Petkov et al.

(10) Patent No.: US 11,879,190 B2
(45) Date of Patent: Jan. 23, 2024

(54) PLUSH PILE KNITTED PRODUCT AND KNITTING MACHINE FOR THE PRODUCTION THEREOF

(71) Applicant: "AGLIKA TRADE" OOD, Veliko Tarnovo (BG)

(72) Inventors: Petko Petkov Petkov, Tvurdica (BG); Yuliyan Petkov Petkov, Veliko Tarnovo (BG); Maya Petkova Petkova, Veliko Tarnovo (BG)

(73) Assignee: "AGLIKA TRADE" OOD, Tarnovo (BG)

( * ) Notice: Subject to any disclaimer, the term of this patent is extended or adjusted under 35 U.S.C. 154(b) by 0 days.

(21) Appl. No.: 17/633,955

(22) PCT Filed: Jul. 24, 2020

(86) PCT No.: PCT/BG2020/000031
§ 371 (c)(1),
(2) Date: Feb. 8, 2022

(87) PCT Pub. No.: WO2021/026619
PCT Pub. Date: Feb. 18, 2021

(65) Prior Publication Data

US 2022/0298684 A1 Sep. 22, 2022

(30) Foreign Application Priority Data

Aug. 9, 2019 (BG) ..... 112981

(51) Int. Cl.
*D04B 21/02* (2006.01)
*D04B 23/08* (2006.01)
(Continued)

(52) U.S. Cl.
CPC ..... *D04B 21/02* (2013.01); *D04B 23/08* (2013.01); *D04B 23/24* (2013.01); *D04B 25/08* (2013.01); *D04B 27/10* (2013.01)

(58) Field of Classification Search
CPC ..... D04B 21/02; D04B 21/04; D04B 23/08; D04B 25/08; D04B 27/10
See application file for complete search history.

(56) References Cited

U.S. PATENT DOCUMENTS 2,907,191 A 10/1959 MacCaffray
4,302,953 A * 12/1981 Wilkens ..... D04B 23/08 66/88

(Continued)

FOREIGN PATENT DOCUMENTS

BG 41939 A1 9/1987
CS 268790 * 1/1992 ..... D04B 25/06

(Continued)

OTHER PUBLICATIONS

International Search Report and Written Opinion for International Application No. PCT/BG2020/000031 dated Nov. 19, 2020.

*Primary Examiner* — Danny Worrell
(74) *Attorney, Agent, or Firm* — Steven War, Esq.; War IP Law PLLC

(57) ABSTRACT

The invention relates to a plush pile knitted product and a knitting machine for the production thereof. Said knitted product comprises knitting threads (9), weft threads (10, 11), and front (14) and rear (12) plush threads, whereas the rear plush threads (12) are cut off at given intervals (a) to form plush pile on the front surface of the product. Said knitting machine comprises a housing (26). On the housing (26), over the entire length of the machine multiple closing safety plates (23) that can move vertically, and push plates (22) for pressing the weft threads (10 and 11) are mounted. Each rear plush plate (8) comprises a cutting disc (27) to cut the rear (Continued)

plush threads (12). Each of the threads (9,14,10,11,12) is fed in using a separate step motor (25).

2 Claims, 8 Drawing Sheets

(51) Int. Cl.
*D04B 23/24* (2006.01)
*D04B 25/08* (2006.01)
*D04B 27/10* (2006.01)

(56) References Cited

U.S. PATENT DOCUMENTS 4,537,048 A * 8/1985 Gutschmit ..... D04B 1/02 66/93
4,712,281 A * 12/1987 Scheller ..... D04B 21/02 28/162
5,259,216 A 11/1993 Zorini
6,832,497 B1 * 12/2004 Rock ..... D04B 35/34 66/195
6,837,078 B1 * 1/2005 Rock ..... D04B 35/34 66/195
7,757,515 B1 * 7/2010 Starbuck ..... D04B 1/02 66/92
2012/0096690 A1 * 4/2012 Chou ..... A44B 18/0034 24/445
2015/0104604 A1 * 4/2015 Rock ..... B32B 5/26 5/413 R
2022/0298684 A1 * 9/2022 Petkov ..... D04B 27/26

FOREIGN PATENT DOCUMENTS

EP 0210580 A2 2/1987
GB 2012828 A 8/1979

* cited by examiner

PLUSH PILE KNITTED PRODUCT AND KNITTING MACHINE FOR THE PRODUCTION THEREOF

FIELD OF THE INVENTION

The invention relates to a plush pile knitted product and a knitting machine for the production thereof and finds applications in the light industry, in particular in the production of knitted fabric products with one-sided or two-sided plush surface.

PRIOR ART

Known from BG 41939 are a knitted product and a knitting machine for the production thereof. That knitted product consists of knitting threads and weft threads forming courses and wales, as well as front and back plush threads. Knitting threads form loops on which the weft threads are applied to obtain a knitted base. The back plush threads are connected between two adjacent wales to form a back plush surface. The front plush threads are knitted into two consecutive courses on two adjacent wales. Weft threads are applied at every four wales for a course, and the weft threads are applied at every four wales for the next course.

The known knitted product is not resistant to unraveling or pulling of the plush threads.

The known machine for the production of a plush pile knitted product comprises a housing wherein a horizontal support rail is installed. Slots are formed on the support rail that hold the knitting needles. Front plush plates and rear plush plates are fixed to the housing and between them are located front weft application needles to guide front weft threads and rear weft application needles to guide rear weft threads forming courses 30. Behind the rear plush plates 8, application needles 6 are located to guide the plush threads. On the front plush plates end of the housing are located application needles to guide the knitting threads forming wales and application needles to guide plush threads. Application needles lie in a plane that is perpendicular to the knitting needles. A main drive is installed in the lower part of the housing with a shaft connected through gears to the knitting needles.

There is a risk that when moving knitting needles backwards they will not close and may remain with tongues open at some positions.

SUMMARY OF THE INVENTION

An objective of the invention is to create a plush pile knitted product that is resistant to unraveling and pulling of the plush threads and creates comfort for the user when used.

Another objective of the invention is to provide a machine for the production of a plush pile knitted item, which ensures uniform heights on the plush surfaces of the knitted items.

The first objective is attained through a knitted item that included knitting threads and front and back weft threads forming wales and courses, as well as front and rear plush threads. The knitting threads form loops in which the front and back weft threads are applied to obtain a knitted base. The rear plush threads are bonded between two adjacent wales to form a rear plush surface while the front plush threads are knitted in two successive courses on two adjacent wales. The front weft threads are applied at every four wales for one course and the rear weft threads are applied at every four wales for the next course.

According to the invention, the rear plush threads are interrupted between two adjacent loop courses to form plush pile on the back surface of the product.

The second objective is attained through a machine for the production of a plush pile knitted item such machine comprising a housing wherein a horizontal support rail is installed; slots are formed in said rail where knitting needles will move. Front plush plates and rear plush plates are fixed to the housing and between them are located front application needles to guide front weft threads and rear application needles to guide rear weft threads forming courses of loops. Behind the rear plush plates 8 are located application needles to guide the rear plush threads. On the front plush plates end of the housing are located first application needles to guide the knitting threads forming wales and second application needles to guide the front plush threads. The front and rear application needles lie in a plane that is perpendicular to the knitting needles. A main drive is installed in the lower part of the housing with a shaft connected through gears to the knitting needles.

According to the invention, multiple closing safety plates that can be moved in the vertical direction are installed on the housing along the entire length of the machine. Push plates are also installed on the housing of the machine to push the front and rear weft threads. A cutting disc is attached to the lower part of each of the rear plush plates to cut the rear plush threads on the course. The knitting threads, the front plush threads, the front weft threads and the rear weft threads are fed in using separate step motors.

The finished knitted product is resistant to unraveling and pulling of the plush threads. The closing safety plates located above the knitting needles ensures closing of the knitting needles to obtain closed loops.

BRIEF DESCRIPTION OF THE DRAWINGS

The invention is explained in the drawings where.

PREFERRED EMBODIMENTS OF THE INVENTION

Figure 1:
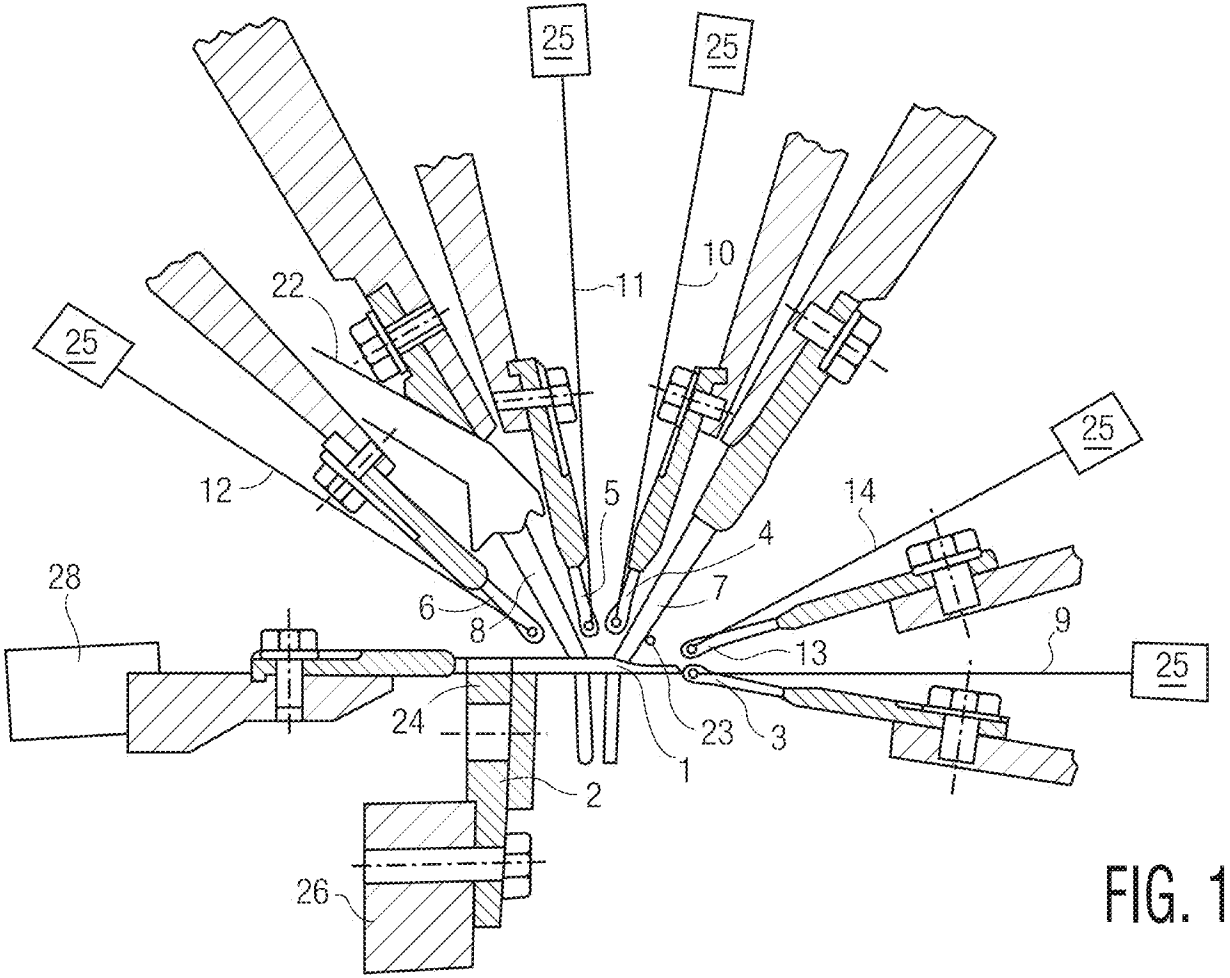
FIG. 1 is a general sectional view of the machine
Figure 2:
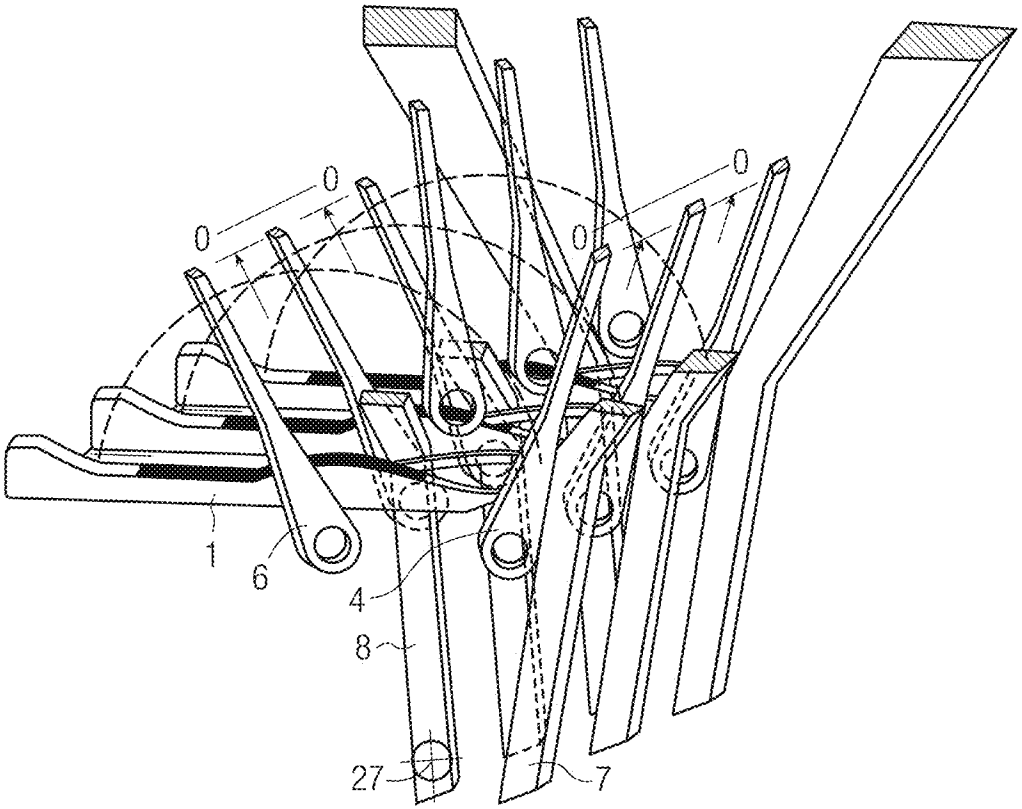
FIG. 2 represents axonometric positions of the machine work components during knitting with the cutting disc
Figure 3:
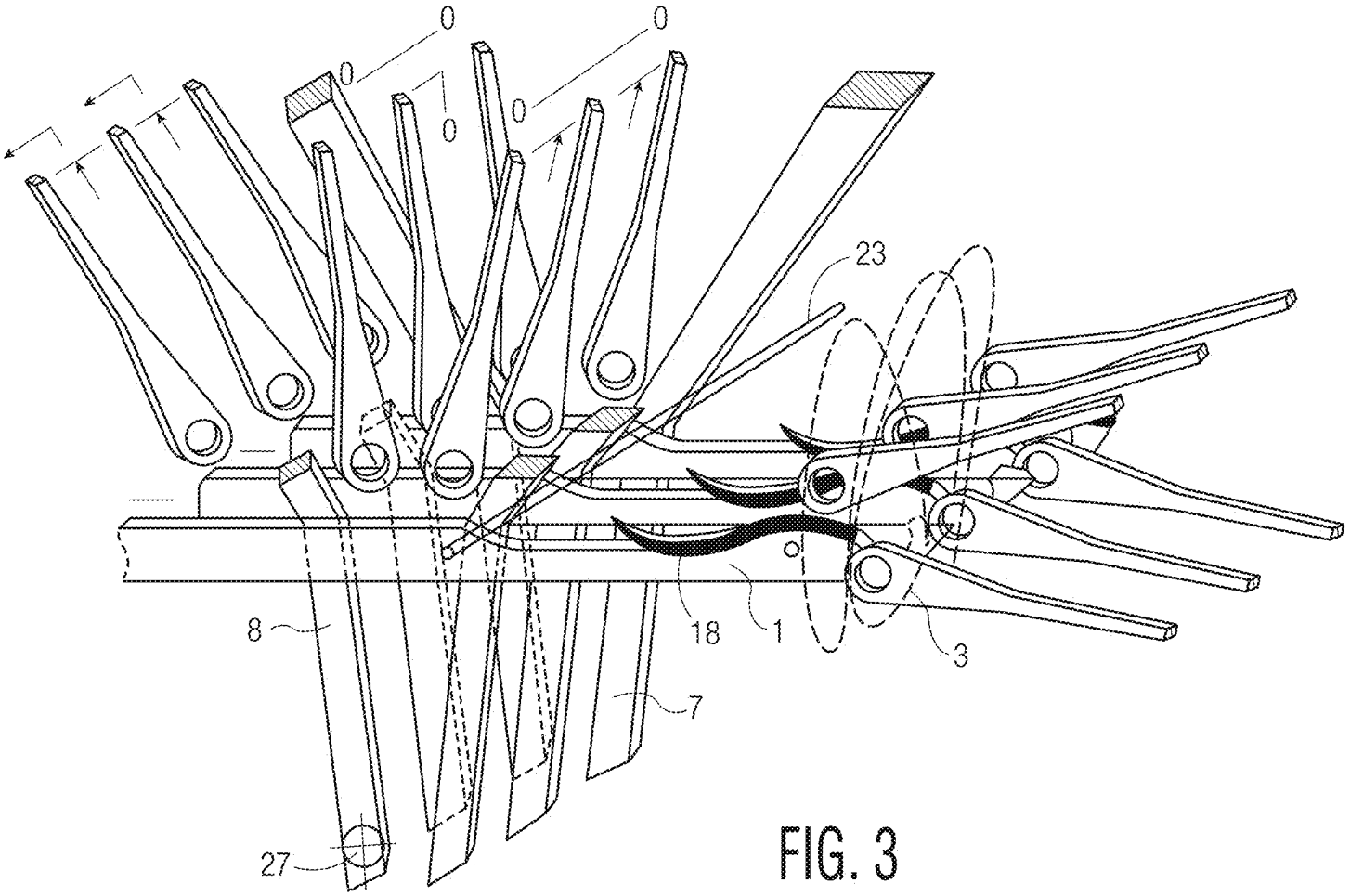
FIG. 3 represents axonometric positions of the machine work components during knitting with the closing plate
Figure 4:
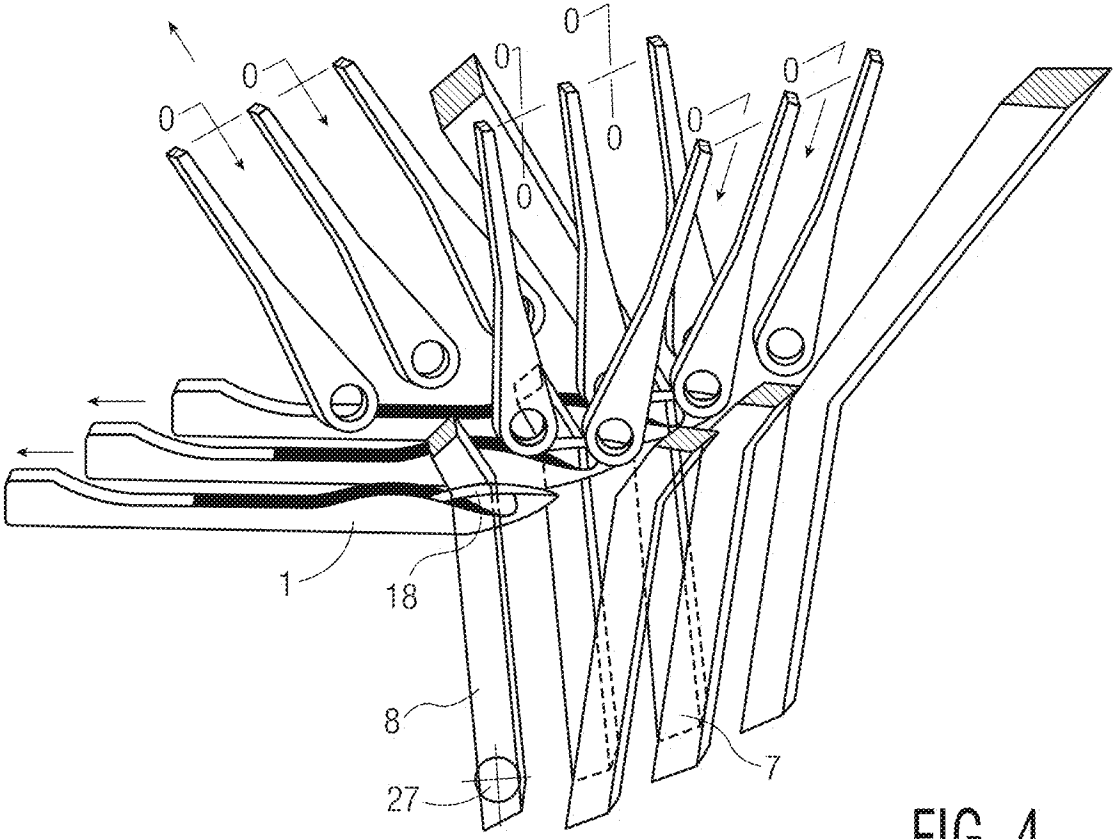
FIG. 4 represents axonometric positions of the machine work components during knitting
Figure 5:
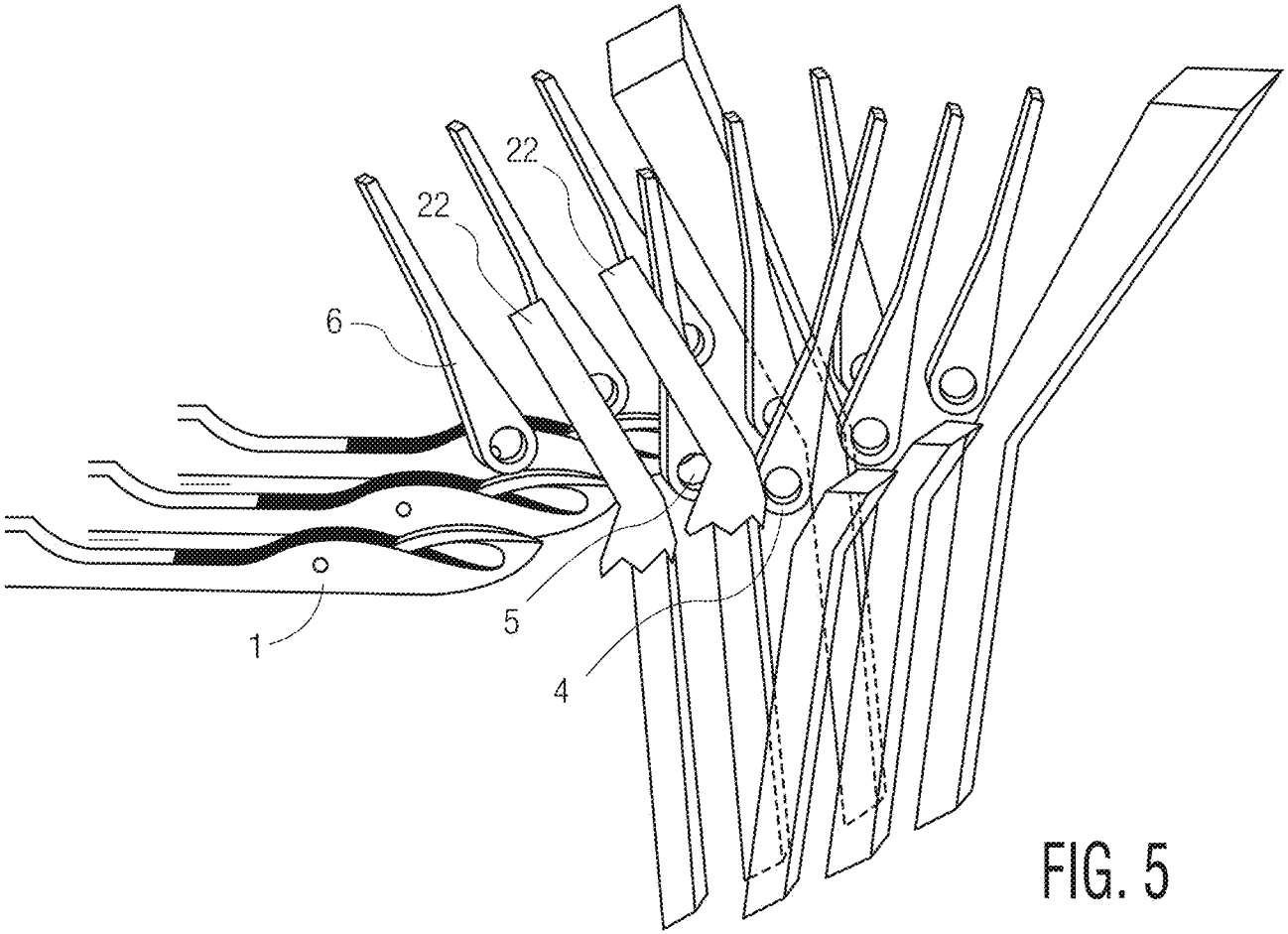
FIG. 5 represents axonometric positions of the machine work components during knitting with the push plate
Figure 6:
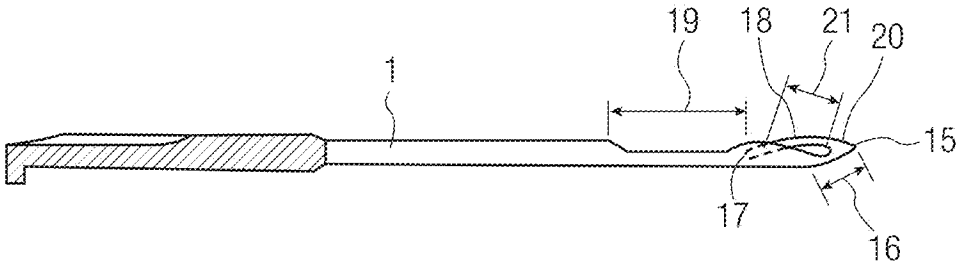
FIG. 6 is a vertical section through the needle support
Figure 7:
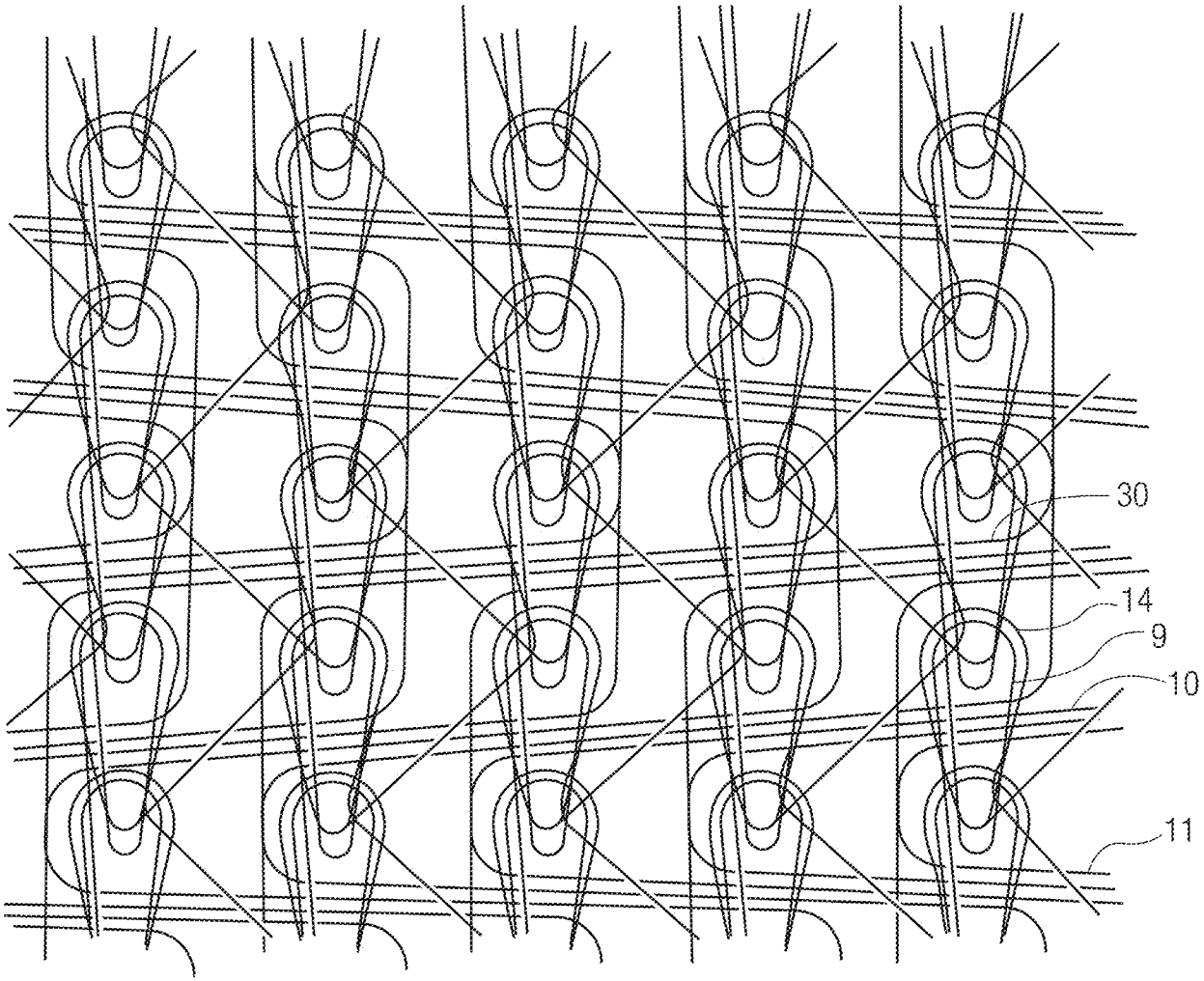
FIG. 7 shows examples of knitted product's structure
Figure 8:
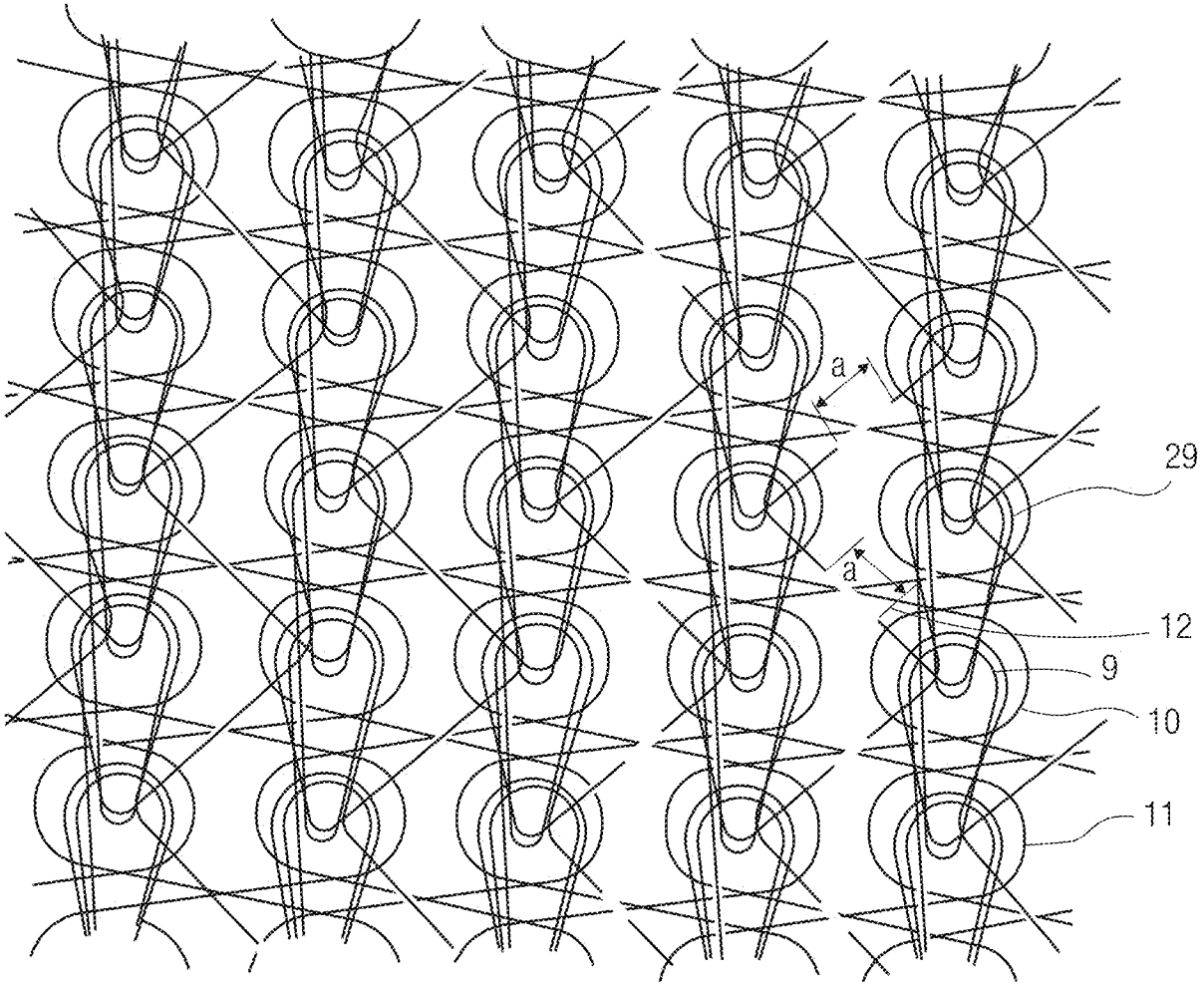
FIG. 8 shows examples of knitted product's structure with plush pile

As can be seen in the attached drawings, the knitted item consists of knitting threads 9 and front and back weft threads 10, 11 forming courses 30 and wales 29, as well as front plush threads 14 and back plush threads 12. The knitting threads 9 form loops in which the front and back weft threads 10, 11 are applied to obtain a knitted base. The rear plush threads 12 are bonded between two adjacent wales 29 to form a rear plush surface, and the front plush threads 14 are knitted in two consecutive courses 30 of two adjacent wales 29. The front weft threads 10 are applied at every four wales 29 for one course 30, and the rear weft threads 11 are applied at every four wales 29 for the next course 30. The rear plush threads 12 are cut at given steps (a) to form a plush pile on the back surface of the item.

The machine for the production of a plush pile knitted product consists of a housing 26 wherein a horizontal support rail 2 is mounted, on which slots 24 are formed, in which knitting needles 1 are placed. The knitting needle 1 consists of a body with a thinner part 19, at the front end of which a tongue 18 is mounted in a widening through a hinge 17, and after the widening a hub 21 is formed, which ends with a hook 20 having a tip 15, under which a pushing surface 16 is formed. Front plush plates 7 and rear plush plates 8 are fixed on the housing 26 and between them are located front application needles 4 guiding the front weft threads 10 and rear application needles 5 guiding the rear weft threads 11 to form courses 30. Behind the rear plush plates 8 are located application needles 6 guiding the rear plush threads 12. To the housing 26, on the side of the front plush plates 7, are placed first application needles 3 guiding the knitting threads 9 to form wales 29 and second application needles 13 guiding the front plush threads 14. The front and rear application needles 4 and 5 lie in a plane perpendicular to the knitting needles 1. In the lower part of the housing 26 is mounted a main drive 28, the shaft of which is connected to the knitting needles 1 by gears. Along the entire length of the machine, multiple closing safety plates 23 are mounted on the housing 26 above the knitting needles 1, which can move in the vertical direction and ensure the closing of the knitting needles 1. On the housing 26 are mounted push plates 22 designed to press the front and rear weft threads 10 and 11. At the lower end of each of the rear plush plates 8 is mounted a cutting disc 27 for cutting the rear plush threads 12 on the knitted course 30. The knitting threads 9, the front plush threads 14, the front weft threads 10, the rear weft threads 11, as well as the rear plush threads 12 are fed in by means of separate step motors 25.

APPLICATION OF THE INVENTION

Upon starting the drive 28, the step motors 25 are switched on and the knitting cycle starts. The knitting needles 1 perform a reciprocating movement back and forth. In the forward direction, the knitting needles 1 go between the rear plush plates 8 and the front plush plates 7 and above the rear plush threads 12 applied by the application needles 6 and the front and back weft threads 10, 11 applied by the front and rear application needles 4 and 5. Upon reaching front dead center, the application needles 3 guiding the knitting threads 9 form a loop wherein the front weft threads 10 are applied to obtain a knitted base. The second application needles 13 apply around the front plush plates 7 front plush threads 14 to obtain a plush surface. Thus, a knitted course 30 is obtained. To form a row, the first application needles 3 perform two movements: left or right shift and up or down movement. The same movements are performed by the second application needles 13, which apply the front plush threads 14 left to right in the knitting needles 1 for the course shown while for the next course the second application needles 13 apply them right to left. Each application needle 13 applies in two consecutive courses the front plush threads 14 on two adjacent knitting needles 1 and form a front plush surface using the front plush plates 7. When moving backwards, the closing safety plates 23 move downwards and close the tongues 18 of the knitting needles 1 before they enter the knitting zone. Upon reaching a third dead center, the knitting needles 1 are released from the old loops with the push plates 22 moving down and pressing on the front 10 and rear weft threads 11 to move them under the knitting needles 1. Thus, the finished course is removed from the needles. Then, the knitting needles 1 move forward and pass above the applied front 10 and rear weft threads 11 to form the next course 30. The back plush threads 12 of the back plush surface are cut off by cutting discs 27, which rotate from the back loop formed around the rear fixed plush plate 8 when the knitted plush item is pulled out of the knitting zone.

The invention claimed is:

1. Knitted product comprising knitting threads (9) and weft threads (10, 11) forming courses (30) and wales (29), as well as front (14) and rear (12) plush threads, whereas the knitting threads (9) form loops on which the weft threads (10, 11) are applied to obtain a knitted base and the rear plush threads (12) are bonded between two adjacent wales (29) to form a rear plush surface and the front plush threads (14) are knitted in two consecutive courses (30) on two adjacent wales (29), whereas the weft threads (10) are applied at every four wales (29) for one course (30) and the weft threads (11) are applied at every four wales (29) for the next course (30), characterized by that the rear plush threads (12) are cut off at given intervals (a) to form plush pile on the front surface of the product.

2. Knitting machine for the production of the plush pile knitted comprising a housing (26) in which a horizontal support rail (2) is installed, whereas slots (24) are formed on the support rail (2) to hold knitting needles (1), whereas on the housing (26) are fixed front plush plates (7) and rear plush plates (8) and between them are located front application needles (4) guiding front weft threads (10), rear application needles (5) guiding rear weft threads (11) to form wales (29), whereas behind the rear plush plates (8) are located application needles (6) guiding the rear plush threads (12), whereas on the housing (26), on the side of the front plush plates (7) are located first application needles (3) guiding knitting threads (9) that form wales (29) and second application needles (13) guiding front plush threads (14), whereas the application needles (4) and (5) lie in a plane perpendicular to the knitting needles (1), whereas in the lower part of the housing (29) a main drive (28) is installed, the shaft of which is connected by gears to the knitting needles (1), characterized by that on the housing (26), over the entire length of the machine, above the knitting needles (1) are installed multiple closing safety plates (23) that can move vertically; on the housing (26) are mounted push plates (22) designed to press the weft threads (10 and 11), whereas in the lower end of each of those rear plush plates (8) is installed a cutting disc (27) to cut off the rear plush threads (12) on the finished course (30), separate step motors (25) are used to feed in the knitting threads (9), the front plush threads (14), the front weft threads (10), the rear weft threads (11) and the rear plush threads (12).

* * * * *